United States Patent [19]

Phillips

[11] Patent Number: 4,472,897

[45] Date of Patent: Sep. 25, 1984

[54] UNIVERSALLY ADJUSTABLE PAPER HOLDER APPARATUS

[76] Inventor: Courtney G. Phillips, 12 Clark St., Iselin, N.J. 08830

[21] Appl. No.: 489,074

[22] Filed: Apr. 27, 1983

[51] Int. Cl.[3] ..... B41J 11/64

[52] U.S. Cl. ..... 40/352; 40/10 R; 40/16

[58] Field of Search ..... 40/352, 16, 10, 152.1, 40/152

[56] References Cited

U.S. PATENT DOCUMENTS

| | | | |
|---|---|---|---|
| 176,088 | 4/1876 | Stapler | 40/352 |
| 198,038 | 12/1877 | Norton | 40/352 |
| 1,025,349 | 5/1912 | Weisberger | 40/606 |
| 2,460,154 | 1/1949 | Stokes | 40/606 |
| 2,899,763 | 8/1959 | Jones | 40/606 |
| 3,296,725 | 1/1967 | Fenwick | 40/10 R |

*Primary Examiner*—Gene Mancene
*Assistant Examiner*—Wenceslao J. Contreras
*Attorney, Agent, or Firm*—Arthur L. Plevy

[57] ABSTRACT

A universally adjustable paper holder comprises first and second vertical extending U-shaped channel members. The vertical extending channel members are coupled to a supporting member in a manner to afford adjustment or separation between the members so that they can be adjusted according to the width of various sizes of paper to be accommodated between channels formed in the vertical U-shaped members. A horizontal cross bar member is adjustably coupled between the vertical members and can be moved in the vertical plane to be utilized as a guide to enable a user to demarcate a particular sentence or line of data which may be implemented on the document being retained by the paper holder.

7 Claims, 6 Drawing Figures

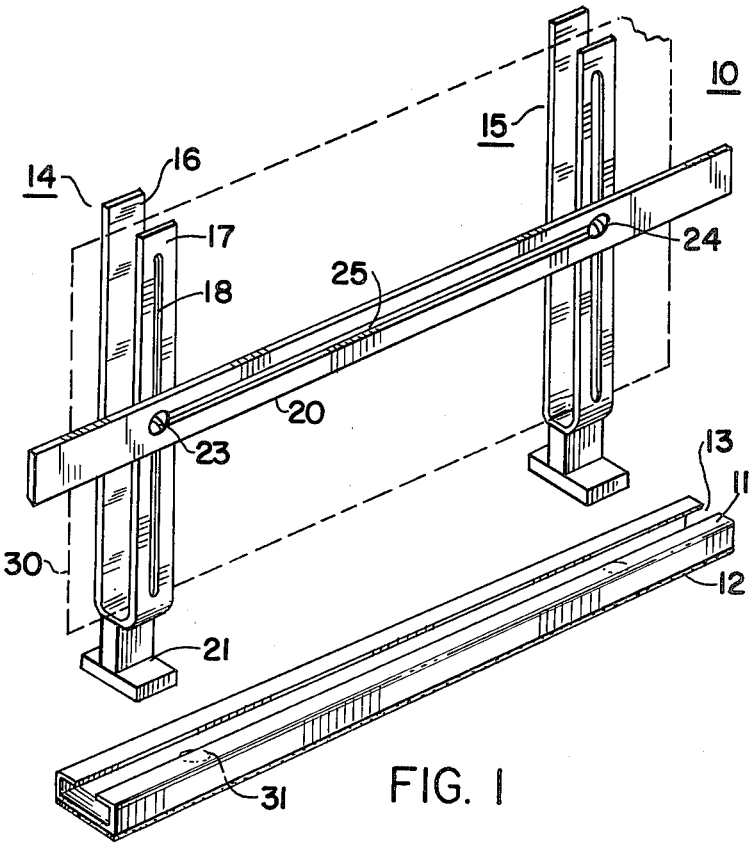
FIG. 1
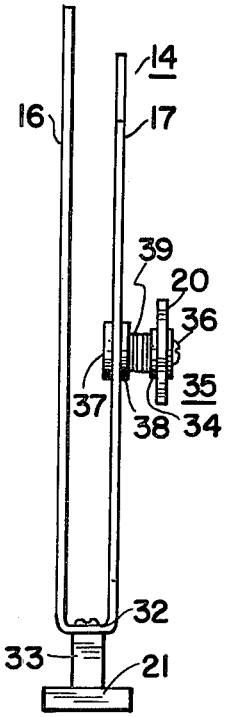
FIG. 2
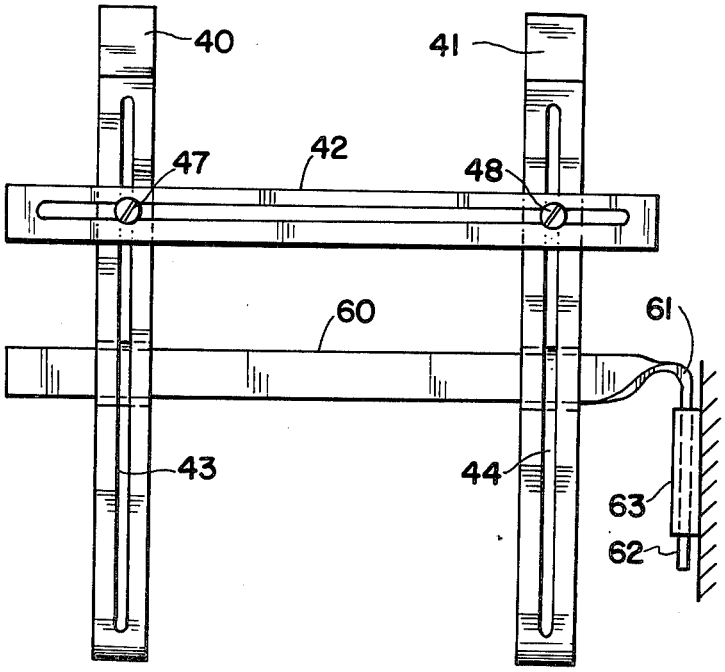
FIG. 4
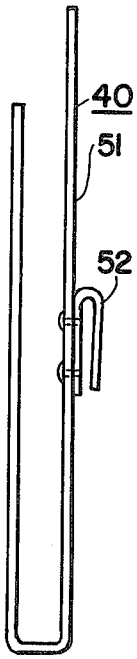
FIG. 3
FIG. 5
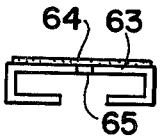
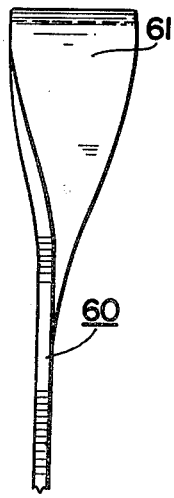
FIG. 6

UNIVERSALLY ADJUSTABLE PAPER HOLDER APPARATUS

BACKGROUND OF THE INVENTION

This invention relates to a support or holder for paper documents and more particularly to a universally adjustable holder of the type adapted to hold papers for a typist or other user.

The prior art is replete with a number of different types of support or holder devices which accommodate a sheet of paper. In particular there is a need for such holders for use by typists who will copy documentation as supported in the holder. As indicated, the prior art is replete with a number of various devices which perform to hold paper or similar articles for reading or typing purposes.

For example, see U.S. Pat. No. 1,651,471 entitled EXTENDER FOR CARD HOLDERS by C. S. Sawyer, issued on Dec. 6, 1927. Essentially, this patent shows a frame member which is adapted to hold different size cards or similar devices. As one can ascertain, it is a fairly complicated device and is expensive to manufacture. Also see U.S. Pat. No. 2,178,542 entitled READING MATTER HOLDER by A. F. Osborn, issued on Nov. 7, 1939. This patent shows a paper holder or a holder for a book which consists of two brackets depending from a common base. The brackets are adjustable to accommodate various size papers. Other patents, as U.S. Pat. No. 2,568,354 entitled TABLE EASEL by G. W. Moore, issued on Sept. 18, 1951, U.S. Pat. No. 3,991,967 entitled BOOK HOLDER by H. Sack, issued on Nov. 16, 1976, and U.S. Pat. No. 2,610,871 entitled MERCHANDISE STAND by W. Bedingfield, issued on Sept. 16, 1952 generally relate to holding books or merchandise or other documentation for the purpose of allowing one to view the same in a convenient manner. As one will ascertain by reviewing such patents, one will realize that the devices supplied by the prior art are relatively complicated, difficult to manufacture and have various disadvantages in regard to the use of the same.

In any event, there is a need for a paper holder which is adjustable in order to accommodate papers of varying sizes. Based on modern technology, there is a great deal of paper generated by computers which are associated with printers. These printers accommodate papers of varying widths and lengths. As is well know, a typical computer facility may include a very limited work area which is congested, with little room available for the source document or copy. Hence based on such consideration, it is desirable to provide a paper holder which can accommodate papers of varying sizes while having the further capability of being positioned or secured to a horizontal or vertical surface which may be associated with the housing of the computer or with other typical apparatus conventionally found within the work area. It is, therefore, a major object of the invention to provide a paper holder which is universally adjustable and which can accommodate papers of varying sizes. The paper holder is extremely simple to construct, is compact, and is relatively inexpensive compared to prior art devices.

BRIEF DESCRIPTION OF THE PREFERRED EMBODIMENT

A universally adjustable paper holder apparatus comprising first and second vertically extending U-shaped channel members, means coupled to said members for moveably positioning one from the other in said vertical plane whereby the separation between said members is adjustable, a horizontal cross bar adjustably coupled between said vertical members and moveable in said vertical plane when said members are selectively separated one from the other a desired distance.

BRIEF DESCRIPTION OF THE FIGURES

FIG. 1 is a perspective plan view of one embodiment of an adjustable paper holder according to this invention.

FIG. 2 is a side elevational view of a vertical channel member employed with this invention.

FIG. 3 is a side elevational view of an alternate embodiment of a vertical channel member.

FIG. 4 is a front plan view of a paper holder utilizing a planar support rod for positioning the paper on a vertical surface.

FIG. 5 is a top plan view of a bracket used in the embodiment of FIG. 4.

FIG. 6 is a top plan view of a planar support member as depicted in FIG. 4.

DETAILED DESCRIPTION OF THE FIGURES

Before proceeding with a detailed description of the FIGURES, related subject matter concerning similar apparatus as contained in this invention was disclosed in Disclosure Document No. 114151, filed on Jan. 19, 1983 in the U.S. Patent Office for the inventor herein.

Referring to FIG. 1, there is shown one embodiment of a document or paper holder 10 according to this invention. A horizontal channel member 11 is depicted. Member 11 has a flat bottom surface for positioning the same on a horizontal surface and may have secured thereto a layer 12 of a suitable adhesive. The channel member 11 has a top slot 13, and essentially, as seen from the FIGURE, has a C-shaped cross sectional configuration. Positioned above horizontal channel member 11 are two vertical members 14 and 15. Each member 14 and 15 is of a U-shaped configuration having a back leg 16 of a larger length then a front leg 17. The members 14 and 15 are identical in configuration and construction. Each front leg of the member as leg 17 has an elongated vertical slot 18 which, as will be explained, is utilized to accommodate a horizontal cross bar member 20.

As can be seen from FIG. 1, the members 14 and 15 are vertically extending U-shaped members. Each member has a bottom flange as flange 21 which can be inserted into the front of the slot 13 in the horizontal channel member 11. The cross bar member 20, as indicated, is coupled by means of a coupling mechanisms 23 and 24 via the horizontal slot 25 in the cross bar member 20. The flanged ends 21 of the vertical members are adapted to be inserted into the slot 13 of the horizontal support member 11.

As can further be seen from FIG. 1, when the vertical members are inserted into the slot, then can be moved to adjust the separation between the members according to the size or width of a sheet of paper 30 to be accommodated (shown in dashed lines). Each vertical member may have one rear leg 16 of approximately 12 inches with the front leg 17 being approximately 10 inches. As seen in FIG. 1, the sheet of paper is inserted between the channels formed by the U-shaped members 14 and 15 between the extending legs 16 and 17. The cross bar member 20 has the horizontal slot 25 which allows one to adjust the separation of the vertical members without the cross bar 20 interfering with the adjustment.

The cross bar member 20 is also adjustable in the vertical plane based on the nature of the coupling devices 23 and 24. Essentially, the cross bar member 20 operates as a guide for a user who may employ the top surface of the member as a ruler to clearly under line or demarcate the particular line of interest and the cross bar 20 is simply adjustable in this manner.

Thus, the apparatus depicted in FIG. 1 can be emplaced on any horizontal surface by means of the horizontal channel member 11 being secured to the surface via the adhesive backing 12. Also shown in the channel member on the bottom surfaces are apertures such as 31 which can also accommodate suitable screws for permanently affixing the channel member 11 to a desired surface.

Referring to FIG. 2, there is shown a side elevational view of a typical vertical channel member as 14. The flange 21 may be secured to the bottom 32 of the U-shaped member by means of a intermediate block 33 or, in fact, the entire vertical member can be fabricated from a suitable plastic or made in sections and secured together. Preferably, the vertical members should be fabricated from a clear or transparent plastic to allow the user to view through the member for portions of the text which might underlie the leg 17. The cross bar 20 is coupled to the vertical slot 18 in member 14 by means of a spring tensioned structure 35.

Essentially, the spring tension structure 35 consists of a screw shaft 36 which is directed through slot 25 in cross bar member 20 and thence through slot 18 in the vertical member 14. The shaft 36 is secured at one end to a washer 37 which is of a larger diameter then the width of the slot. Another washer 38 abuts against the slot 17. A spring 39 is positioned between washer 38 and another washer 39. Essentially, the spring exerts a force between washers 38 and 39 which holds the cross bar member in a fixed position. By a slight compression of the spring 39 which is done manually, one can move the cross bar member 20 within the slots 18 of the vertical members and the member 20 will maintain any position after the force is removed. In this manner the cross bar member is completely adjustable in the vertical plane and can maintain any position due to the operation of the spring mechanism 35.

Referring to FIG. 3, there is shown a side view of an alternate embodiment of a vertical support member such as members 14 and 15 of FIG. 1. Essentially, the member 40 of FIG. 3 is identical in construction to members 14 and 15 with the exception that there is no bottom flanged surface. Member 40 has secured to the back leg 41 a U-shaped hook apparatus 52. In many environments it may be difficult to position the vertical members on a horizontal surface.

Hence referring to FIG. 4, there is shown a coupling technique whereby member 40 and 41 each of an identical configuration are associated with a cross bar 42 of a similar configuration to cross bar 20 of FIG. 1. Accordingly, the cross bar 42 is also secured to the vertical slots 43 and 44 by means of spring mechanisms 47 and 48 which are similar to the mechanism 35 shown in FIG. 2. The U-shaped hook 52 is positioned over a horizontal planar member 60 which has a bend 61 at one end resulting in a transverse section 62 which is adapted to be supported in a bracket 63 to enable one to secure the same to a vertical surface as the side of a video desk terminal or so on.

As shown in FIG. 5, the bracket 63 may also have an adhesive backing 64 with a screw accommodating aperture 65 for securing the same to a vertical surface. The bracket 63 also has a C-shaped configuration and is similar, for example in cross section, to the horizontal channel member 11 as depicted in FIG. 1.

FIG. 6 shows a top view of the horizontal planar member 60 which may also be fabricated from plastic and has an arcuate bend or a twist to form the transverse section 62.

As can be seen from the above description, the paper supporting member essentially consists of the two vertical extending U-shaped channel members as 14 and 15 of FIG. 1 and 40 and 41 of FIG. 4. Each member consists of a long back leg with a shorter front leg with each front leg having a slot for accommodating the cross bar ruler members as 20 and 42. The vertical extending channel members can be adapted to be adjustable in the horizontal plane by means of the flanges for horizontal surface use or by means of the U-shaped hook members for vertical support or some other means.

Due to the length of the legs, a sheet of paper normally will rest upon the back leg and hence be positioned at a convenient angle for use. By way of example only as previously indicated, the following dimensions have been employed in implementing a structure as shown in FIG. 1. The back leg 16 of each vertical member is approximately 12 inches from the base with the front leg 17 being about 10 inches, the slot 18 begins about 1 inch from the bottom of the vertical member and extends vertically on the surface of leg 17 to about 1 inch from the top. The cross bar member is approximately 16 inches in length with the slot 25 being about 9 inches. The horizontal channel is about 12 inches in length and about 1 inch in width with the slot 13 being approximately $\frac{1}{2}$ inch. The width of each vertical member as 14 and 15 is approximately $\frac{3}{4}$ inch with the width of the cross bar member 20 about one inch.

As indicated, the above noted dimensions are by way of example but are found sufficient to accommodate most conventional sizes of paper presently utilized in computer and related fields. It is of course apparent that these dimensions can be changed or altered as necessary. It is of course understood that there are many alternative constructions which will be discerned by one skilled in art. In regard to such alternative constructions, one may employ different flange shapes as well as different shaped apertures for accomplishing the final result.

It is also understood that the cross bar member can be coupled to the vertical extending members by many other various techniques and structures.

It will be apparent to one skilled in the art that many modifications and alternatives may be discerned when reading the above specification and all such alternative embodiments are deemed to be encompassed within the breadth and scope of the claims as appended hereto.

I claim:

1. A universally adjustable paper holder apparatus comprising:

a first and a second vertical channel member of a U-shaped configuration with the back leg of said U being longer than the front leg and having a common base, with the front leg of said U having an elongated vertical slot, means coupled to said first and second vertical channel members to moveably adjust said members to vary the separation of said members in said vertical plane, with said channel between the legs of said members aligned to allow a paper sheet to be accommodated therein, a planar cross bar member having an elongated slot and positioned horizontally between said front legs of said vertical channel members with the slot of said cross bar member overlying the slots of said channel member, and coupling means inserted through said slots to allow said cross bar member to move in both the vertical and horizontal planes as desired.

2. The universally adjustable paper holder apparatus according to claim 1 further comprising;

a horizontal channel member adapted to be positioned via a bottom surface thereof on a horizontal surface, said horizontal channel member having an elongated top slot on a top surface thereof and means secured to the bottom common surface of said U-shaped vertical channel members for positioning the same in said slot to allow each of said vertical channel members to move along said horizontal member whereby the separation between said members is adjustable.

3. The universally adjustable paper holder apparatus according to claim 1 further comprising;

a horizontal planar member having one end adapted to be secured to a relatively transverse surface to allow said planar member to extend in the horizontal plane, first and second coupling members each one separately secured to a back surface of a corresponding leg of said U-shaped vertical member to allow said U-shaped vertical members to move along said planar member in said horizontal plane.

4. The universally adjustable paper holder apparatus according to claim 3 further comprising;

said coupling member secured to the back surface of said U-shaped vertical member is an inverted U-shaped member with ommon bottom surface positioned over the top surface of said horizontal plane member.

5. The universally adjustable paper holder apparatus according to claim 3 further comprising;

said horizontal planar member has a transverse surface and adapted to receive said transverse bend to cause said planar member to extend in the horizontal plane.

6. The universally adjustable paper holder apparatus according to claim 1, wherein said vertical channel members are fabricated from a clear plastic.

7. The universally adjustable paper holder apparatus according to claim 2, wherein said bottom surface of said horizontal channel member has an adhesive backing for securing the same to said surface.

* * * * *